US005589322A

United States Patent [19]

Lobo et al.

[11] Patent Number: 5,589,322

[45] Date of Patent: Dec. 31, 1996

[54] PROCESS FOR MAKING A DIRECT DISPERSION OF A PHOTOGRAPHICALLY USEFUL MATERIAL

[75] Inventors: Lloyd A. Lobo, Webster; Aileen M. Svereika, Rochester, both of N.Y.

[73] Assignee: Eastman Kodak Company, Rochester, N.Y.

[21] Appl. No.: 570,995

[22] Filed: Dec. 12, 1995

[51] Int. Cl.[6] ..... G03C 7/388; G03C 1/025; G03C 1/38; G03C 1/005

[52] U.S. Cl. ..... 430/449; 252/326; 252/335; 252/340; 252/349; 252/354; 252/356; 430/545; 430/546; 430/628; 430/631; 430/634; 430/640

[58] Field of Search ..... 430/545, 546, 430/631, 634, 628, 640, 449; 252/326, 340, 335, 349, 354, 356

[56] References Cited

U.S. PATENT DOCUMENTS

| | | | |
|---|---|---|---|
| 3,022,172 | 2/1962 | Ohba et al. | 430/628 |
| 3,250,620 | 5/1966 | Lovett et al. | 430/640 |
| 3,335,128 | 8/1967 | Hiatt et al. | 260/215 |
| 3,655,407 | 4/1972 | McGraw | 430/627 |
| 3,767,410 | 10/1973 | Brust et al. | 430/637 |
| 3,907,572 | 9/1975 | Ueda et al. | 430/449 |
| 4,004,927 | 1/1977 | Yamamoto et al. | 430/523 |
| 4,166,050 | 8/1979 | Miyazako et al. | 430/539 |
| 4,198,478 | 4/1980 | Yoneyama et al. | 430/499 |
| 4,211,836 | 7/1980 | Yoneyama et al. | 430/449 |
| 4,291,113 | 9/1981 | Minamizono et al. | 430/202 |
| 4,501,589 | 2/1985 | Sakaguchi et al. | 430/139 |
| 4,569,905 | 2/1986 | Mukunoki et al. | 430/546 |
| 4,751,174 | 6/1988 | Toya | 430/502 |
| 4,908,155 | 3/1990 | Leemans et al. | 430/528 |
| 4,935,338 | 6/1990 | Masuda et al. | 430/631 |
| 4,939,077 | 7/1990 | Helling et al. | 430/527 |
| 5,051,350 | 9/1991 | Terai et al. | 430/569 |
| 5,356,768 | 10/1994 | Bertramini et al. | 430/546 |

FOREIGN PATENT DOCUMENTS

| | | |
|---|---|---|
| 213768 | 9/1984 | German Dem. Rep. . |
| 276743 | 3/1990 | German Dem. Rep. . |
| 288250 | 3/1991 | German Dem. Rep. . |
| 3914947 | 8/1990 | Germany . |
| 4034871 | 5/1992 | Germany . |
| 0476543 | of 0000 | Japan . |

*Primary Examiner*—Richard L. Schilling
*Attorney, Agent, or Firm*—Andrew J. Anderson

[57] ABSTRACT

A process for making a direct dispersion of a photographically useful material is disclosed comprising subjecting a mixture of an aqueous gelatin solution, a liquid organic phase comprising a photographically useful material, and an ionic polymer to conditions of high shear or turbulence to form a fine dispersion of the organic phase having an average particle size of less than 0.5 micron dispersed in the aqueous solution; wherein the ratio of the organic phase viscosity to the aqueous gelatin solution viscosity in the absence of the ionic polymer, measured at the temperature of the dispersion forming step, is greater than a value of 2.0, and the ionic polymer is a water soluble or dispersible substantially non-surface active polyelectrolyte which has a molecular weight of at least 10,000 selected from: i) synthetic polymers derived from at least 5 mole % of monomers which contain —$OSO_3M$, —$SO_3M$, —COOM, or —$OPO(OM)_2$ substituent groups where M represents a hydrogen atom or a cationic counterion, and ii) polysaccharide materials bearing at least one substituent group as described in i) per saccharide unit. The present invention facilitates the creation of finely dispersed liquid organic phase oil drops containing an oil soluble PUM, without the need of an auxiliary solvent, without the need to add high levels of the hydrophilic colloid and without the need to use high homogenizing temperatures. Further, the present invention facilitates the preparation of equally fine particle dispersions when the level of permanent solvent has been reduced.

16 Claims, No Drawings

PROCESS FOR MAKING A DIRECT DISPERSION OF A PHOTOGRAPHICALLY USEFUL MATERIAL

FIELD OF THE INVENTION

This invention relates to methods of making dispersions of photographically useful materials in aqueous solutions. More particularly this invention relates to a process of making a fine photographic direct dispersion in the absence of auxiliary solvents.

BACKGROUND OF THE INVENTION

The use of aqueous dispersions of photographic couplers and other hydrophobic photographically useful compounds is known in the art. Generally, dispersions of hydrophobic photographically useful materials (PUMs) in aqueous solutions are prepared by one of the following ways: milling of solid particles using the well known methods of comminution; precipitation of photographically useful materials from solution; and homogenization of a liquid organic phase containing a photographically useful material into an aqueous solution containing a hydrophilic colloid such as gelatin and, optionally, a surface active material.

Processes for homogenization of liquid organic phases frequently include the use of low boiling or at least partially water miscible auxiliary solvents, which auxiliary solvent is subsequently removed after homogenization by evaporating volatile solvent or washing water miscible solvents. Such auxiliary solvents facilitate combining couplers and/or any other hydrophobic dispersion components in a mixed solution, so that a dispersion with an oil phase of uniform composition is obtained. The solvent also lowers the viscosity of the oil solution, which allows the preparation of small-particle emulsified dispersions. The use of auxiliary solvent may also be used to form a liquid organic solution of a PUM for forming a dispersion where no permanent solvent is desired in the final dispersion. However, the use of auxiliary solvent also presents several difficulties in the preparation of photographic dispersions and elements. Auxiliary solvents can cause severe coating defects if not removed before the coating operation. Also, it is not possible, due to thermodynamic considerations, to remove 100% of the auxiliary solvent from the dispersion. This may cause other deleterious effects such as enhancing the solubility and movement of the PUM, or aid in crystallization. Further, the steps of evaporating volatile solvent from an evaporated dispersion and washing a chill-set, washed dispersion often leads to final photographic dispersions with variable concentration; so that careful analysis is necessary to determine the actual concentration of the photographically useful compound in the dispersion. Volatile or water-soluble auxiliary solvents present health, safety, and environmental hazards, with risks of exposure, fire, and contamination of air and water. The cost can be significant for the solvent itself, as can be the costs of environmental and safety controls, solvent recovery, and solvent disposal.

Alternatively, PUMs may be "directly" homogenized or dispersed into an aqueous solution in the substantial absence of any auxiliary solvent (i.e., absence of such solvents beyond trace or impurity levels). In one such direct dispersion process, the hydrophobic components desired in the dispersion, e.g., coupler and permanent coupler solvent, are simply melted at a temperature sufficient to obtain a homogeneous oil solution. This is then emulsified or dispersed in an aqueous phase, often containing gelatin and surfactant.

The direct process also yields a dispersion with a known concentration of the photographically useful compound, based on the components added, with no variability due to evaporation or washing steps. No volatile or water-soluble organic solvents are needed, eliminating the hazards and costs associated with their use.

While small-particle dispersions of less than 1 micron diameter can be obtained by direct dispersion processes with appropriate emulsification conditions, the direct dispersion process in general leads to larger particle sizes than that obtained with auxiliary solvents. Additionally, for most photographic dispersions, permanent solvent is used to promote reactivity of the PUM. To compensate for the absence of auxiliary solvents in a direct dispersion process, higher levels of permanent solvent may be used. At high levels of such permanent solvents, however, the volume of the oil drops in the film will increase, thereby causing a deterioration in the optical properties of the film. Additionally, high levels of permanent solvent will also cause a deterioration in the mechanical properties of the film. Accordingly, it is desired to keep levels of permanent solvent low. However, at low levels of solvent relative to the PUM, there is typically a large increase in the liquid organic phase viscosity which makes it increasingly difficult to obtain small dispersion particle sizes for the organic phase in the aqueous solution.

Factors that affect organic phase particle size in a photographic dispersion include homogenizer power, interfacial tension, and viscosity of the water phase relative to the liquid organic phase. Increases in homogenizer power can be used to decrease dispersion particle size, but such effect is limited by process hardware. Interfacial tension can be lowered to decrease dispersion particle size by increasing the level of surface active material. However, the interfacial tension obtainable with a given surface active material levels off to a lower limit beyond the critical micelle concentration of the surfactant. It has also been found that lowering the interfacial tension has a minimal effect on reducing particle size when the oil viscosity is high. Additionally, it is not desirable to have large amounts of surface active materials, because it creates problems during coating of photographic layers of a photographic element as well as the propensity of PUMs to grow crystals during storage of dispersions.

The viscosity ratio of the aqueous phase relative to the liquid organic (oil) phase has also been found to affect dispersion particle size (see, e.g., "Encyclopedia of Emulsion Technology", Chapter II, Ed. P. Becher, Marcel Dekker, New York, 1983). Generally, as the ratio of the organic phase viscosity to the aqueous phase viscosity (at the temperature of homogenization) is decreased, smaller dispersion particle sizes are achieved. This effect is particularly evident where auxiliary solvents are used to decrease the organic phase viscosity. Increasing the homogenizing temperature during formation of a dispersion may also lower the organic/aqueous viscosity ratio. However, the use of higher temperatures is limited by the boiling point of the aqueous phase. Also, some PUMs and hydrophilic colloids, like gelatin, can chemically degrade at elevated temperatures. Another method of decreasing the organic/aqueous viscosity ratio is by increasing the level of hydrophilic colloid, which in turn increases the viscosity of the aqueous phase. While this approach helps solve the problem of particle size, it also causes the level of hydrophilic colloid, relative to the PUM, to increase. This is undesirable because photographic layer coating melts containing such dispersions will have a high level of hydrophilic colloid binder, which can limit the minimum dry thickness of films coated with such coating melts.

It is known to use synthetic polymers to increase the viscosity of aqueous gelatin solutions for coating purposes. Polymeric agents which increase the viscosity of aqueous solutions can be broadly classified into two groups: materials which have inherent viscosifying capabilities by virtue of their large molecular weight in combination with the associative nature of the polymer molecules with other like polymer molecules; and ionic polymers such as polyelectrolytes which form associative complexes with charged groups of gelatin which is the hydrophilic colloid typically used in dispersion making. It is known in the art of coating photographic materials, e.g., to incorporate polymers containing acid groups such as carboxyl, sulfonate or sulfate groups into coating solutions to increase the viscosity of coating solutions for photographic layers. U.S. Pat. No. 3,022,172, e.g., discloses sulfonates of vinyl, allyl, styrene or alkyl benzene compounds to increase the viscosity of gelatin coating solutions, in levels of 0.02–30% by weight of gelatin, to improve the uniformity of coatings. Photographic Science & Engineering Vol. 14, pages 178–183 discloses that ammonium salts of maleic anhydride and methyl vinyl ether, polystyrene sulfonate, poly vinyl ammonium phthalate, dextran sodium sulfate etc., can be employed as viscosity increasing agents for gelatin. U.S. Pat. No. 3,655,407 discloses acrylic acid/alkyl acrylate copolymers to increase the viscosity of gelatin solutions to improve coating uniformity. U.S. Pat. No. 4,166,050 and DD 213,768 disclose maleic anhydride copolymers as viscosifiers for gelatin solutions. DD 276,243 suggests the use of polymers containing mixed carboxylate sulfonate groups for viscosifying gelatin solutions and increased robustness to pH changes. DE 4,034,871 discloses copolymers of maleic anhydride having pendent sulfonic acid groups.

Polysaccharides containing anionic moieties have also been disclosed as viscosifiers for gelatin solutions. Naturally occurring polysaccharides, like carrageenan, have been disclosed in U.S. Pat. No. 3,250,620. Furthermore, synthetically modified polysaccharides containing anionic moieties have been disclosed as viscosifiers for gelatin solutions. For example, U.S. Pat. No. 3,335,128 discloses cellulose sulfate with mixed cations. U.S. Pat. No. 3,767,410 discloses polysaccharides where 50% of the hydroxyl groups are acetylated or sulfated. DE 3,914,947 discloses sulfoethyl substituted cellulose.

It is also known in the art to use surface active polymers as dispersing aids. U.S. Pat. No. 4,569,905 discloses anionic polymers which are specified to be surface active. U.S. Pat. No. 4,198,478 discloses sulfonated polymers which are also specified to be surface active. The surface active polymers act by reducing the interfacial tension at the oil/water interface. In order to be effective, they need to diffuse relatively rapidly during homogenization, therefore the preferred molecular weight of such polymers specified in these patents is less than 10,000. In order to be surface active their chemical structure also requires them to have a hydrophobic moiety on these molecules, placed within the polymer backbone or attached to the backbone, separate from the anionic moiety. Due to the presence of the hydrophobic moieties, these molecules form self-aggregates, or micelles, which make them ineffective viscosifiers even at high molecular weights. U.S. Pat. No. 4,935,338 discloses the use of anionic polymers and polysaccharides as dispersing aids for polymeric latexes. However, these dispersions are not of the oil-in-water type and are, consequently, not subject to particle size reduction.

U.S. Pat. No. 4,291,113 discloses the use of sulfonated polymers to prevent growth of particles in photographic dispersions, when they are stored at elevated temperatures. There is no suggestion, however, to use polymers of any desired molecular weight range, or at any organic phase to aqueous phase viscosity ratios within which these materials are effective at substantially reducing the particle size of the resulting dispersion.

Problems to be Solved

It would be desirable to create small particle photographic dispersions of PUMs without increasing the level of surface active material or the hydrophilic colloid, without increasing the homogenizing temperature and without the use of auxiliary solvents. It would be particularly desirable to obtain such small particle size dispersions without a substantial increase in the non-volatile components of the dispersion.

SUMMARY OF THE INVENTION

Accordingly, it is one object of this invention to obtain small particle dispersions without the use of auxiliary solvent. Another object of this invention is to obtain small particle dispersions with the use of minimal amount of hydrophilic colloid. Yet another object of this invention is to obtain small particle size dispersions without the need to increase homogenizing temperatures. Yet another object is to reduce the high boiling permanent solvent level in a dispersion without obtaining an increase in the average particle size. Other objects of this invention will be apparent in this disclosure.

These and other objectives are achieved in accordance with the process of the invention, which comprises a process for making a direct dispersion of a photographically useful material comprising: subjecting a mixture of an aqueous gelatin solution, a liquid organic phase comprising a photographically useful material, and an ionic polymer to conditions of high shear or turbulence to form a fine dispersion of the organic phase having an average particle size of less than 0.5 micron dispersed in the aqueous solution; wherein the ratio of the organic phase viscosity to the aqueous gelatin solution viscosity in the absence of the ionic polymer, measured at the temperature of the dispersion forming step, is greater than a value of 2.0, and the ionic polymer is a water soluble or dispersible substantially non-surface active polyelectrolyte which has a molecular weight of at least 10,000 selected from: i) synthetic polymers derived from at least 5 mole % of monomers which contain $—OSO_3M$, $—SO_3M$, —COOM, or $—OPO(OM)_2$ substituent groups where M represents a hydrogen atom or a cationic counterion, and ii) polysaccharide materials bearing at least one substituent group as described in i) per saccharide unit.

In preferred embodiments of the invention, the ionic polymer is added at levels of up to 50% by weight with respect to the weight of the gelatin, prior to homogenization, and are preferably within a molecular weight range of 10,000–1,000,000.

DETAILED DESCRIPTION OF THE INVENTION

The process of the invention is generally applicable to forming aqueous dispersions of hydrophobic photographically useful materials (PUMs) which may be used at various locations throughout a photographic element. Dispersions formed in accordance with the invention may be used in single color or multicolor photographic elements. Multicolor elements typically contain image dye-forming units sensitive to each of the three primary regions of the spectrum.

Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographically useful materials which may be dispersed in accordance with the invention include photographic couplers (including yellow, magenta and cyan image-forming couplers, colored or masking couplers, inhibitor-releasing couplers, and bleach accelerator-releasing couplers, dye-releasing couplers, etc.), UV absorbers, preformed dyes (including filter dyes), high-boiling organic solvents, reducing agents (including oxidized developer scavengers and nucleators), stabilizers (including image stabilizers, stain-control agents, and developer scavengers), developing agents, development boosters, development inhibitors and development moderators, optical brighteners, lubricants, etc. After formation of a dispersion in accordance with the invention, the resulting dispersion may be incorporated in a photographic coating layer in accordance with known practices.

In the following discussion of suitable materials for use in the dispersions of the invention and photographic elements that can be used in conjunction with such dispersions, reference will be made to *Research Disclosure,* September 1994, Item 36544, published by Kenneth Mason Publications, Ltd., Dudley House, 12 North Street, Emsworth, Hampshire P010 7DQ, ENGLAND, which will be identified hereafter by the term "*Research Disclosure.*" The contents of the *Research Disclosure,* including the patents and publications referenced therein, are incorporated herein by reference, and the Sections hereafter referred to are Sections of the *Research Disclosure,* Item 36544.

Silver halide emulsions employed in photographic elements can be either negative-working or positive-working. Silver halide emulsions suitable for use in elements comprising dispersions formed in accordance with the invention, and their preparation as well as methods of chemical and spectral sensitization, are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating feanures, supports, exposure and processing can be found in Sections XI–XX.

In practicing the present invention a hydrophobic PUM is melted by heat or dissolved in an organic solvent prior to homogenization. Materials that have a relatively low melting point, e.g. below 90° C., can be dispersed without the use of organic solvents. The molten mixture of the PUM with or without the permanent solvent is termed the liquid organic (or oil) phase.

Where the liquid organic, or oil phase, includes an organic solvent, it is preferred to use high-boiling or permanent organic solvents. High boiling solvents have a boiling point sufficiently high, generally above 150° C. at atmospheric pressure, such that they are not evaporated under normal dispersion making and photographic layer coating procedures. Non-limiting examples of high boiling organic solvents that may be used include the following.

S-1 Dibutyl phthalate
S-2 Tritolyl phosphate
S-3 N,N-Diethyldodecanamide
S-4 Tris(2-ethylhexyl)phosphate
S-5 Octyl oleate monoepoxide
S-6 2,5-Di-t-pentylphenol
S-7 Acetyl tributyl citrate
S-8 1,4-Cyclohexylenedimethylene bis(2-ethylhexanoate)
S-9 Bis(2-ethylhexyl) phthalate
S-10 2-phenylethyl benzoate
S-11 Dibutyl sebacate
S-12 N,N-Dibutyldodecanamide
S-13 Oleyl alcohol
S-14 2-(2-Butoxyethoxy)ethyl acetate It is an advantage of the process of the invention that auxiliary solvents are not essential for forming fine dispersions, and it is preferred that they not be included. Inclusion of such solvents, however, may be desirable to achieve photographic properties not directly related to the dispersion making process, and their presence will not interfere with the process of the invention. Most useful auxiliary solvents are water immiscible, volatile solvents, and solvents with limited water solubility which are not completely water miscible. Non-limiting examples of these include the following.

A-1 Ethyl acetate
A-2 Cyclohexanone
A-3 4-Methyl-2-pentanol
A-4 Triethyl phosphate
A-5 Methylene chloride
A-6 Tetrahydrofuran The aqueous phase of the dispersions of the invention comprises gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. The gelatin is preferably used in levels up to 30 wt % based on the total amount of the aqueous phase, more preferably up to 10%.

It is preferable to include low molecular weight (e.g., molecular weight less than 10,000, particularly less than 1,000) surfactants in the aqueous solution. The low molecular weight surfactant is preferably an anionic or nonionic surfactant. For purposes of this invention, a surfactant is a surface active material which is capable of depressing the surface tension of distilled water by at least 20 dynes/cm at its critical micelle concentration at 25° C. Anionic surface active agents preferably have the $—SO_3^-$ or $—OSO_3^-$ moiety. Preferred anionic surface active agents include naphtalenesulfonic acids, sulfosuccinic acids, alkylbenzenesulfonic acids, alkylsulfonates, alkylsulfates and alkylbenzenesulfonates. Preferred nonionic surface active agents include compounds of the formula $$R\text{-}0\text{-}(CH_2CH_2O)_nH$$

where R is alkyi, aryl or aralkyl and n is from 5 to 30. A suitable amount of the surface active agent is up to 50% based on the gelatin used, preferably up to 20% and most preferably up to 10%. The aqueous solution containing the gelatin and any surfactant is termed the aqueous phase of the dispersion. Ratios of surfactant to liquid organic phase solution typically are in the range of 0.5 to 25 wt. % for forming small particle photographic dispersions, which ratios are also useful for the invention dispersions. Useful surfactants include, but are not limited to the following.

F-1

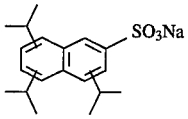

F-2 $CF_3-(CF_2)_7-SO_3Na$

F-3 $CH_3-(CH_2)_n-SO_3Na$ n = 12–14

F-4

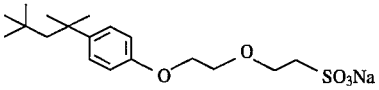

F-5 $CH_3-(CH_2)_{11}-OSO_3Na$

F-6

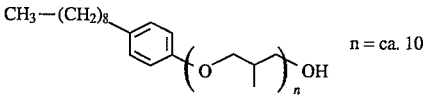

n = ca. 10

F-7

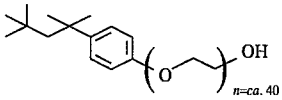

F-8

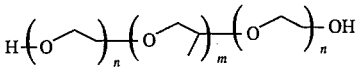

n = ca. 6
m = ca. 22

F-9

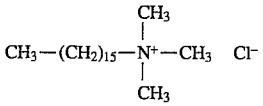

F-10

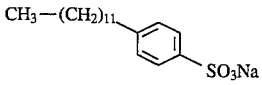

F-11

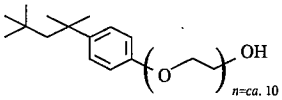

Devices suitable for the high-shear or turbulent mixing of the dispersions of the invention include those generally suitable for preparing submicron photographic emulsified dispersions. These include but are not limited to blade mixers, colloid mills, homogenizer devices in which a liquid stream is pumped at high pressure through an orifice or interaction chamber, sonication, Gaulin mills, homogenizers, blenders, microfluidizers, rotor stator devices, etc. More than one type of device may be used to prepare the dispersions. For the purposes of this invention.: "high shear or turbulent conditions" defines shear and turbulence conditions sufficient to generate a small particle conventional photographic dispersion with an average particle size of less than about 0.5 micron.

In accordance with the present invention, the viscosity ratio, q, is defined as the quotient of the viscosity of the liquid organic phase to that of the aqueous phase, in the absence of the ionic polymer, measured at the temperature of homogenization. According to the present invention, we have found that when the value of q is greater than 2.0, it is beneficial in terms of obtaining smaller sized dispersion particles to add ionic synthetic polymers or natural polymers containing anionic groups. The polymeric agents that are found to be useful can be broadly classified into 2 groups:

a) synthetic water soluble or dispersible polymers derived from monomers having one or more pendant anionic groups selected from —$OSO_3M$, —$SO_3M$, —COOM, or —$OPO(OM)_2$ where M represents a hydrogen atom or a cationic counterion such as an alkali metal, an alkaline earth metal atom, or a quaternary ammonium base, etc., and b) naturally occurring polymeric materials, such as polysaccharides, that have on average at least one, and preferably at least two, pendant anionic groups per repeat unit as described in a) or which have been modified to have such pendent groups.

Generally, the polyelectrolytes useful in the present invention are well known in the art and some are commercially available. Typically they comprise synthetic water soluble homo- or co-polymers bearing pendant ionic groups as described above, or water dispersible polymers such as polymeric latices with similar ionic surface groups. The copolymers comprise addition or condensation copolymers. Examples of polyelectrolytes include polystyrene sulfonate, poly(acrylamide-co-2-acrylamido-2-methylpropane sulfonate), poly(styrene-co-maleic acid), Poly(acrylamide-co-2-acrylamido-2-methylpropane carboxylate), poly(styrene-co-acrylamide), polyacrylic acid, poly (styrene carboxylate-co-acrylamide), poly (2-acrylamido-2-methylpropane sulfonate-co-maleic acid), polyesterionomers such as Eastman AQ55D™, latices such as acrylic acid containing copolymers. Examples of naturally occurring polymers such as polysaccharides that have at least on average one pendant anionic group as described above per saccharide unit or naturally occuring polymers which have been modified to have such anionic groups include dextran sulfate and cellulose sulfate, carboxylated or sulfonated carbohydrate ethers and sulfated polysaccharides. Among polysaccharides, dextran sulfate is preferred. Examples of preferred synthetic polyelectrolytes include polystyrene sulfonate, Poly(acrylamide-co-2-acrylamido-2-methylpropane carboxylate), poly-(styrene-co-acrylamide), polyacrylic acid, poly (styrene carboxylate-co-acrylamide), poly (2-acrylamido-2-methylpropane sulfonate-co-maleic acid).

Since the association between the polyelectrolyte and the gelatin is ionic in nature, the preferred polyelectrolytes include those in which the level of the ionic component and the molecular weight is the highest. Here the efficiency of the polyelectrolyte is the highest, i.e., the smallest quantity is required to perform its job. In some cases, however, to ensure its compatibility with the gelatin binder and other components, copolymers are used with a judicious choice of the comonomers and the molecular weight of the polyelectrolyte.

Since the role of the ionic polymer is to increase the effective viscosity of the aqueous phase it is preferred to have a high ionic component and a high molecular weight. The percentage of ionic monomer required to efficiently increase the viscosity of the aqueous phase through association with gelatin is generally inversely proportional to the molecular weight of the polyelectrolyte. However, it has been unexpectedly found that polymers with a relatively wide range of ionic content, e.g. from 20 to 100 mole % of ionic monomer, and a relatively wide range of molecular weight, e.g. 50,000 to 800,000 perform with substantially the same efficiency. In some instances it is preferred that the viscosity of the dispersion not be increased substantially due to the addition of the polymer. In this case it is preferred that the molecular weight be as low as possible. However, it is found that when the molecular weight approaches 10,000, the efficacy of the polymer in reducing the particle size drops significantly. Additionally, when the molecular weight is too high the coarse dispersion containing polymer can be too viscous to homogenize efficiently. Therefore, the specific preferred ranges of the polymer molecular weight are from about 10,000–1,000,000. Within such ranges, the molecular weights are more preferably above about 20,000, and most preferably above about 50,000. Also within such ranges, the molecular weights are more preferably below about 800,000, and most preferably less than about 500,000. Similarly the viscosity is affected by the amount of ionic monomer in the polymer. When this amount is dropped the viscosifying power of the polymer is lower. The efficacy of the polymer in creating small particle size dispersions, however, is substantially unaffected when the level of ionic monomer is changed between 20 and 100 mole %. However, when the level is 20% and below this efficacy starts to drop, especially where the level is below 5 mole %. Therefore, it is specified that the preferred level of ionic monomer be greater than 5 mol %, and more preferably greater than 20 mol %.

The ionic polymers used in accordance with the invention are further specified as being relatively non-surface active. For purposes of this invention, "non-surface active" is meant to describe materials which are incapable of depressing the surface tension of distilled water by at least 20 dynes/cm at their critical micelle concentration at 25° C.

The amount of polyelectrolyte used is preferably about 0.1 to 50 wt %, more preferably from about 1 to 40 wt % and most preferably about 1 to 25 wt %, the percentages being by weight of the gelatin. If the level of polyelectrolyte is too low to provide effective association with the gelatin, dispersion particle size may not be minimized, while if the level is very high the solution viscosity may be too high for efficient emulsification operations. Additionally, it is desired to optimize the combined level of gelatin and polyelectrolyte in order to minimize photographic layer thickness.

Illustrative examples of polyelectrolytes which can be advantageously used in the present invention include those having the following structures. While not indicated in all the structures, the artionic substituents are associated with either hydrogen or a cationic counterion such as an alkali metal, an alkaline earth metal atom, or a quaternary ammonium base, etc., as represented by M in some of the structures. Where a particular counterion is depicted, such as sodium, it is anticipated that other counterions may be substituted therefor. Monomer ratios and polymer molecular weights for the following polymers may be varied over wide ranges, and are preferably selected so as to be within the preferred ionic monomer and molecular weight ranges specified above.

[I]

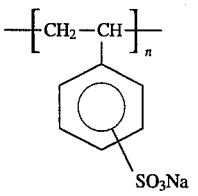

[II]

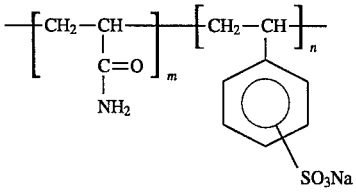

-continued

[III]

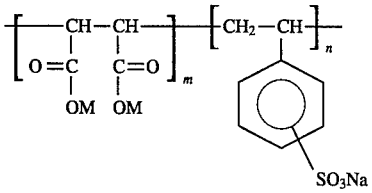

[IV]

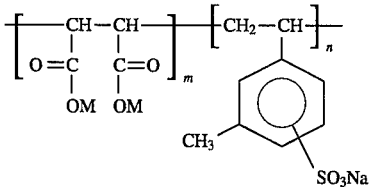

[V]

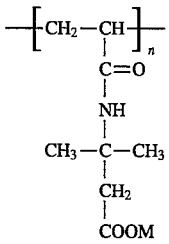

[VI]

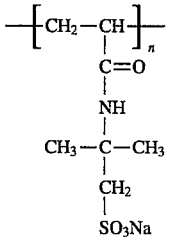

[VII]

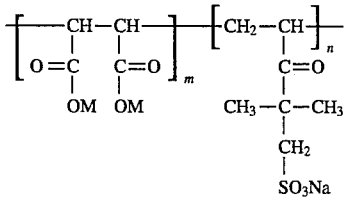

[VIII]

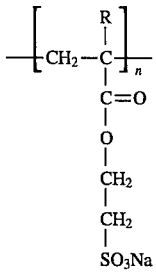

where R is H or $C_1$–$C_4$ alkyl

[IX]

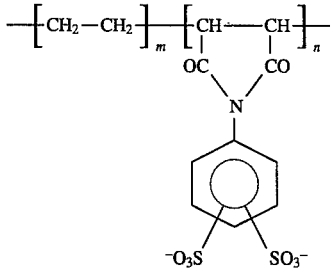

-continued

[X]

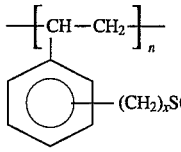

x = 1–4

[XI]

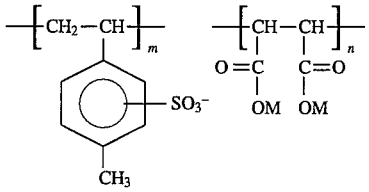

[XII]

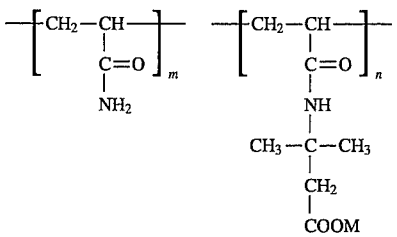

[XIII]

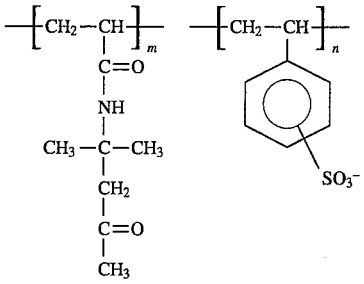

[XIV]

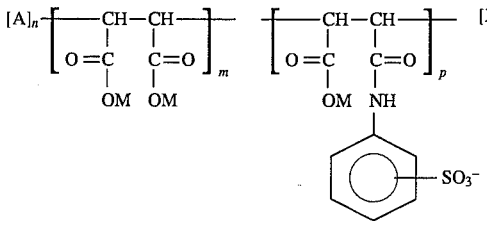

A represents styrene, ethylene, propylene, or methylstyrene

[XV]

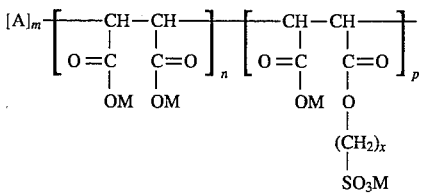

A represents styrene, ethylene, propylene, or methylstyrene x = 1–4

[XVI]

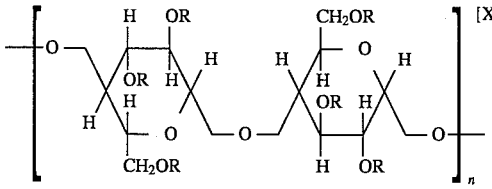

-continued

R is sulfoethyl

[XVII]

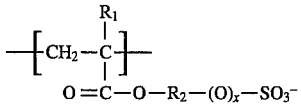

x=0 or 1

$R_1$ is H or $C_1$–$C_4$ alkyl $R_2$ is $C_1$–$C_4$ alkylene

[XVIII]

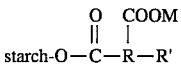

R is dimethylene or trimethylene

R' is $C_2$–$C_8$ alkyl, $C_2$–$C_8$ alkenyl, aralkyl or aralkenyl

[XIX]

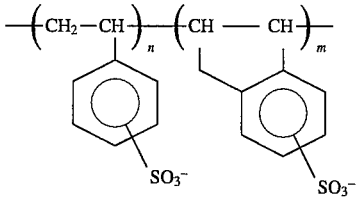

[XX]

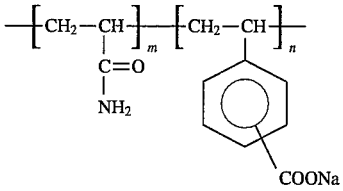

[XXI]

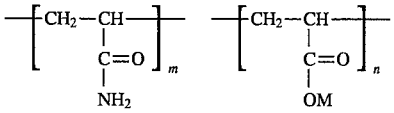

The addition of the ionic polymer results in an increase in the viscosity of the aqueous phase of the dispersions. At a given level of polymer, the amount of the viscosity increase depends on the type of anions in the polymer and is proportional to the level of anionic monomer and molecular weight of the polymer. The dispersion viscosity is also a function of the size of the gelatin molecules. The viscosity of gelatin solutions is particularly sensitive to the fraction of the gelatin molecules which have a molecular weight greater than 150,000, which typically constitute the β fragment and microgel fragment of hydrolyzed collagen (from which gelatin is obtained). Conventional photographic lime processed gelatin typically contains greater than 40% by weight of molecules having a molecular weight greater than 150,000 daltons, as measured by size exclusion chromatography. Where the above mentioned viscosity increase is undesirable, in accordance with a preferred embodiment of this invention the ionic polymer may be used in combination with gelatins whose fraction of molecules greater than 150,000 daltons is less than 0.35.

In accordance with preferred embodiments, the process of the invention is used to form aqueous dispersion of image dye-forming couplers. Couplers that form cyan dyes upon reaction with oxidized color developing agents include those described in such representative patents and publications as: U.S. Pat. Nos. 2,772,162; 2,895,826; 3,002,836; 3,034,892; 2,474,293; 2,423,730; 2,367,531; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent include those described in such representative patents and publications as: U.S. Pat. Nos. 2,600,788; 2,369,489; 2,343,703; 2,311,082; 3,152,896; 3,519,429; 3,062,653; 2,908,573 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent include those described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. In a preferred embodiment of the invention, an acetanilide yellow coupler is used which has the formula:

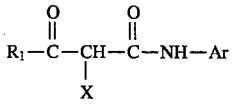

wherein $R_1$ is an alkyl, aryl, anilino, alkylamino or heterocyclic group; Ar is an aryl group; and X is hydrogen or a coupling-off group. The $R_1$, Ar and X groups may each contain further substituents as is well known in the art. In particularly preferred embodiments of the invention a pivaloylacetanilide yellow coupler is used wherein $R_1$ is t-butyl.

Ar is preferably substituted phenyl wherein at least one substituent is halo, alkoxy or aryloxy. Ar preferably additionally contains a ballasting group. Ballasting groups usually comprise one or more 5 to 25 carbon atom containing organic moieties whose function is to immobilize the coupler and the formed image dye during photographic development by imparting poor water diffusibility to the coupler compound.

Coupling-off groups are generally organic groups which are released during photographic processing. The released coupling-off group can be a photographically useful group. Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Generally the presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728, 1,531,927, 1,533,039, 2,006,755A and 2,017,704A, the disclosures of which are incorporated herein by reference.

Dispersions of the invention are preferably used in a typical multicolor photographic element, which may comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Such element can contain additional layers, such as filter layers, interlayers, overcoat layers, subbing layers, and the like, containing dispersions prepared in accordance with the invention.

If desired, the photographic element can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ. ENGLAND. It is further contemplated that the dispersions of the invention may also be advantageously used with the materials and processes described in an article titled "Typical and Preferred Color Paper, Color Negative, and Color Reversal Photographic Elements and Processing," published in *Research Disclosure,* February 1995, Volume 370.

By practicing the present invention one can create finely dispersed liquid organic phase oil drops containing an oil soluble PUM, without the need of an auxiliary solvent, without the need to add high levels of the hydrophilic colloid and without the need to use high homogenizing temperatures. Further, the present invention facilitates the preparation of equally fine particle dispersions when the level of permanent solvent has been reduced. The method of practicing the present invention and the above mentioned benefits are demonstrated in the following illustrative examples.

EXAMPLES

Method of Homogenizing:

The aqueous phase in the following examples was made up by mixing gelatin, surfactant and water, with the indicated amount of ionic polymer added using a 10% solution of the polymer. The surfactant used in the illustrative examples is a commercial surfactant which is a mixture of diisopropyl and triisopropyl naphthalene sulfonate (surfactant F-1 illustrated above). The surfactant was used in all examples at a level of 0.8% by weight of the aqueous phase. The concentrations of gelatin and polymer are reported based on the weight percent of the material in the aqueous phase. The oil (organic phase) solutions were made by dissolving either yellow coupler 1 or 2 illustrated below as the PUM in the permanent solvent dibutyl phthalate. The dissolution of the coupler was carried out at 100° C. The aqueous and organic solutions were mixed at the indicated homogenizing temperature.

coupler 1

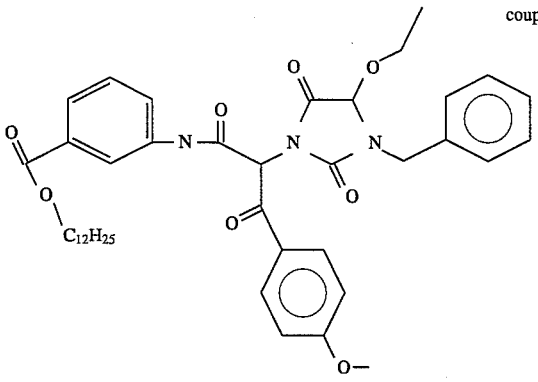

-continued coupler 2

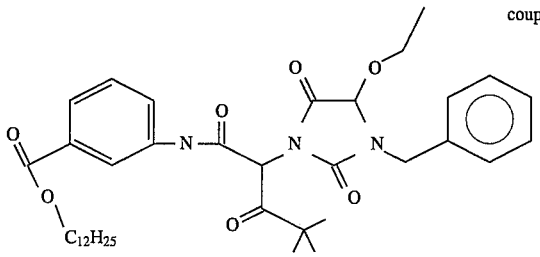

Coarse dispersions were prepared by mixing the aqueous and organic phases with a Brinkmann rotor stator device at 8000 rpm at the desired homogenization temperature. The coarse dispersion contained 18% by weight of the oil phase. The homogenization to achieve a fine particle dispersion was done by passing the coarse dispersion through an APV Crepaco homogenizer fitted with an orifice type homogenizing element. The homogenization pressure was set to 5000 psi.

Particle Size Measurements:

Organic phase particle size measurements were made by measuring the turbidity of the dispersion sample at a known dilution using near-infrared light. The mean dispersion particle size was related to turbidity by the theory of light scattering of colloidal particles. Samples with known particle size are used to calibrate the instrument. Particle sizes that are reported are mean sizes which are related to the weight average particle size.

Viscosities:

The viscosity of the aqueous phase, $\mu_c$, is the viscosity of the aqueous phase containing gelatin and surfactant, without polymer. The independent phases are Newtonian, and their viscosities are independent of shear rate. Dispersion viscosities which are non-Newtonian are measured at 45° C. and reported at $37.5s^{-1}$. Viscosities and the ratio of the viscosities, q, were measured and reported at temperatures equal to the homogenization temperature using a Brookfield cone & plate instrument and a Brookfield concentric cylinder apparatus.

Polymer molecular weights are reported based on the manufacturers specifications. For non commercial polymers, the intrinsic viscosity of polymer solution was measured. The intrinsic viscosity is related to the molecular weight of the polymer by Mark-Houwink parameters, as described in "Properties of Polymers", 2nd Ed., Ch. 9, Van Krevelen, Elsevier, New York, 1980.

Example 1

The following dispersions were made with yellow coupler 1. The oil phase consisted of one part by weight of coupler 1 and one part by weight of coupler solvent. The polymer used in the experiment was compound I, polystyrene sulfonate, manufactured by National Starch Co., with a specified molecular weight of 500,000. The homogenization temperature was 45° C.

| Dispersion # | gel level % | aq. phase visc. cp | oil phase visc cp | q | polymer level % | particle size μm | comments |
|---|---|---|---|---|---|---|---|
| 1-1 | 2 | 2.15 | 85 | 39.5 | 0 | 0.4107 | check |
| 1-2 | 2 | 2.15 | 85 | 39.5 | 0.1 | .3902 | invention |
| 1-3 | 2 | 2.15 | 85 | 39.5 | 0.4 | .3264 | invention |
| 1-4 | 2 | 2.15 | 85 | 39.5 | 0.8 | .3013 | invention |
| 1-5 | 4 | 11.5 | 85 | 7.39 | 0 | 0.3339 | check |
| 1-6 | 4 | 11.5 | 85 | 7.39 | 0.1 | 0.3107 | invention |
| 1-7 | 4 | 11.5 | 85 | 7.39 | 0.4 | .2845 | invention |
| 1-8 | 4 | 11.5 | 85 | 7.39 | 0.7 | .2685 | invention |
| 1-9 | 8 | 55 | 85 | 1.54 | 0 | .2588 | check |
| 1-10 | 8 | 55 | 85 | 1.54 | 0.2 | .2448 | comparison |
| 1-11 | 8 | 55 | 85 | 1.54 | .75 | .2338 | comparison |
| 1-12 | 8 | 55 | 85 | 1.54 | 1.0 | .2357 | comparison |
| 1-13 | 10 | 71 | 85 | 1.2 | 0 | .2395 | check |
| 1-14 | 10 | 71 | 85 | 1.2 | 0.5 | .2267 | comparison |
| 1-15 | 10 | 71 | 85 | 1.2 | 1.0 | .2394 | comparison |

It is seen that when the viscosity ratio q is greater than 2.0 there is a substantial benefit in reducing the particle size by adding a polyelectrolyte in accordance with the invention. A smaller amount of polymer can be added compared to the amount of gelatin that would need to be added to obtain the same particle size. When q is less than 2.0 the change in the particle size by adding polymer is very small and almost the same reduction in particle size would be obtained by adding equal amounts of gelatin instead of polymer.

Example 2

Coupler 1 was used as the PUM. The oil phase consisted of one part by weight of Coupler 1 and one part by weight of coupler solvent. The gelatin concentration in the aqueous phase was kept at 4%. The same polymer described in Example 1 was used. The measured properties are described below.

| Dispersion # | homog. temp °C. | aq. phase visc cp | phase visc cp | q | polymer level % | particle size μm |
|---|---|---|---|---|---|---|
| 2-1 | 45 | 11.5 | 85 | 7.39 | 0 | 0.3358 |
| 2-2 | 45 | 11.5 | 85 | 7.39 | 0.5 | .2845 |
| 2-3 | 45 | 11.5 | 85 | 7.39 | 0.75 | .2658 |
| 2-4 | 60 | 6.5 | 38 | 5.85 | 0 | .2955 |
| 2-5 | 60 | 6.5 | 38 | 5.85 | 0.5 | .2524 |
| 2-6 | 60 | 6.5 | 38 | 5.85 | 0.75 | .2396 |
| 2-7 | 75 | 4.2 | 20.5 | 4.9 | 0 | .2715 |
| 2-8 | 75 | 4.2 | 20.5 | 4.9 | 0.5 | .2410 |
| 2-9 | 75 | 4.2 | 20.5 | 4.9 | 0.75 | .2261 |

At all the temperatures the viscosity ratio q is greater than 2.0, and it is found to be beneficial to add polymer to reduce the particle size. The data shows that a small amount of polymer (dispersion #3) can be used at a lower temperature of 45° C., to obtain a similar particle size, in the absence of polymer, obtained by raising the homogenization temperature to 75° C. Additionally, it is seen that a combination of raising temperature and adding polymer yields the smallest particle size.

Example 3

In this set of experiments both Coupler 1 and Coupler 2 were used at varying solvent ratios and levels of gelatin. The homogenization temperature was 45° C. The viscosities of the aqueous phases are the same as described in Example 1 at corresponding gelatin level. The same polymer described in Example 1 was used.

| Dispersion # | coupler type | gel level % | coupler: solvent | oil phase visc cp | q | polymer level % | part. size μm |
|---|---|---|---|---|---|---|---|
| 3-1 | 1 | 4 | 1:1 | 85 | 7.39 | 0 | 0.3339 |
| 3-2 | 1 | 4 | 1:1 | 85 | 7.39 | 0.7 | .2685 |
| 3-3 | 1 | 8 | 1:1 | 85 | 1.54 | 0 | .2588 |
| 3-4 | 1 | 8 | 1:1 | 85 | 1.54 | 0.75 | .2358 |
| 3-5 | 1 | 4 | 1:0.5 | 316 | 27.48 | 0 | .3668 |
| 3-6 | 1 | 4 | 1:0.5 | 316 | 27.48 | 0.75 | .3054 |
| 3-7 | 1 | 8 | 1:0.5 | 316 | 5.75 | 0 | .3187 |
| 3-8 | 1 | 8 | 1:0.5 | 316 | 5.75 | 0.75 | .2502 |
| 3-9 | 1 | 4 | 1:0.33 | 754 | 65.56 | 0 | .398 |
| 3-10 | 1 | 4 | 1:0.33 | 754 | 65.56 | 0.75 | .3421 |
| 3-11 | 1 | 8 | 1:0.33 | 754 | 13.7 | 0 | .3325 |
| 3-12 | 1 | 8 | 1:0.33 | 754 | 13.7 | 0.75 | .2842 |
| 3-13 | 2 | 4 | 1:1 | 97.6 | 8.48 | 0 | .3613 |
| 3-14 | 2 | 4 | 1:1 | 97.6 | 8.48 | 0.5 | .2919 |
| 3-15 | 2 | 8 | 1:1 | 97.6 | 1.77 | 0 | .2715 |
| 3-16 | 2 | 8 | 1:1 | 97.6 | 1.77 | 0.5 | .2417 |
| 3-17 | 2 | 4 | 1:0.5 | 724 | 62.95 | 0 | .4645 |
| 3-18 | 2 | 4 | 1:0.5 | 724 | 6295 | 0.5 | .3838 |
| 3-19 | 2 | 8 | 1:0.5 | 724 | 13.16 | 0 | .3537 |
| 3-20 | 2 | 8 | 1:0.5 | 724 | 13.16 | 0.5 | .3034 |
| 3-21 | 2 | 4 | 1:0.33 | 2391 | 207.9 | 0 | .5281 |
| 3-22 | 2 | 4 | 1:0.33 | 2391 | 207.9 | 0.5 | .4421 |
| 3-23 | 2 | 8 | 1:0.33 | 2391 | 43.47 | 0 | .4037 |
| 3-24 | 2 | 8 | 1:0.33 | 2391 | 43.47 | 0.75 | .3513 |

The data shows that when the viscosity ratio falls below a value of 2.0, the benefit in adding polymer is small, i.e. the particle size change is less than 0.03 μm. At values of q greater than 2.0 the benefit is large i.e., the particle size change is greater than 0.05 μm. The example also illustrates that when the level of coupler solvent is reduced, the particle size increase observed in the absence of polymer can be overcome by adding small levels of polymer.

Example 4

Coupler 1 was used as the PUM. The oil phase consisted of one part by weight of Coupler 1 and one part by weight of coupler solvent. The gelatin concentration in the aqueous phase was kept at 4%. The homogenization temperature was 45° C. The viscosities of the aqueous phases and the oil phase are same as described in Example 1 at corresponding gelatin level. The value of q for this system is 7.4. Compound II was used as the polyelectrolyte with varying levels of the ionic component in the copolymer, while the intrinsic viscosity of the polymer was maintained approximately constant.

| Dispersion # | mole % of ionic monomer | polymer level % | particle size μm |
|---|---|---|---|
| 4-1 (check) | — | 0 | .3385 |
| 4-2 | 100 | 0.75 | .2755 |
| 4-3 | 58 | 0.75 | .2727 |
| 4-4 | 8 | 0.75 | .2874 |
| 4-5 | 0 | 0.75 | .3223 |

The efficacy of the copolymer is not affected substantially by the level of the ionic comonomer till the level drops below 8%. With the nonionic homopolymer there is no substantial benefit to the dispersion particle size reduction.

Example 5

The oil phase consisted of one part by weight of coupler 1 and one part by weight of coupler solvent. The gelatin concentration in the aqueous phase was kept at 4%. The homogenization temperature was 45° C. The viscosities of the aqueous phases and the oil phase are same as described in Example 1 at corresponding gelatin level. The value of q for this system is 7.4. Compound I with different molecular weights was used as the polymeric dispersing aid.

| Dispersion # | polymer mol. wt. | polymer level % | particle size μm | dispersion visc. cp |
|---|---|---|---|---|
| 5-1 (check) | — | 0 | 0.3199 | 19.25 |
| 5-2 | 800,000 | 0.75 | .2584 | 2060 |
| 5-3 | 110,000 | 0.75 | .2552 | 424 |

-continued

| Dispersion # | polymer mol. wt. | polymer level % | particle size μm | dispersion visc. cp |
|---|---|---|---|---|
| 5-4 | 55,000 | 0.75 | .2524 | 177 |
| 5-5 | 10,000 | 0.75 | .2772 | 35.0 |

The efficacy of the polymer is substantially independent of the molecular weight of the polymer till the molecular weight approaches 10,000. However, the dispersion viscosity is a strong function of the molecular weight of the polymer. Therefore, in some instances it is preferable to use relatively lower molecular weight polymers to have the combined benefit of low dispersion viscosity and small particle size.

Example 6

The oil phase consisted of one part by weight of coupler 1 and one part by weight of coupler solvent. The gelatin concentration in the aqueous phase was kept at 4%. The homogenization temperature was 45° C. The viscosities of the aqueous phases and the oil phase are same as described in Example 1 at corresponding gelatin level. The value of q for this system is 7.4. Polymeric compounds having different ionic moieties as well as mixed ionic species were compared. m/n refers to the ratio of the monomers as specified in the structures. Polysaccharides dextran sulfate (comprising two $SO_4^-$ groups per saccharide unit), xanthan (comprising two $COO^-$ groups per five saccharide units) and carrageenan (comprising a mixture of i-carrageenan having one sulfate group per saccharide unit and k-carrageenan having one sulfate group per two saccharide units, for an average of less than one sulfate group per saccharide unit) were also evaluated in a similar manner. Each polymer had a molecular weight of greater than about 500,000.

| Dispersion # | polymer type | m/n | polymer level % | particle size μm |
|---|---|---|---|---|
| 6-1 (check) | — | — | 0 | .3416 |
| 6-2 | compound XII | .68/1 | 0.75 | .2623 |
| 6-3 | compound XX | 0.6/1 | 0.75 | .2722 |
| 6-4 | compound XXI | 0.25/1 | 0.75 | .2560 |
| 6-5 | compound VII | 0.5/1 | 0.75 | .273 |
| 6-6 | dextran sulfate | — | 0.5 | .2763 |
| 6-7 | xanthan | — | 0.5 | .3560 |
| 6-8 | carrageenan | — | 0.5 | .3306 |

Polymers which have ionic monomers containing sulfonate, carboxylate, sulfate and copolymers having mixed ionic species are effective at reducing the particle size. The polysaccharide dextran sulfate is also an effective dispersion aid, while polysaccharides having an average of less than one ionic group per saccharide unit were relatively ineffective.

Example 7

Dispersions were made as in Example 6, except various nonionic polymers and polyacrylic acid were used.

| Dispersion # | polymer type | Mol. wt. | polymer level % | particle size μm |
|---|---|---|---|---|
| 7-1 (check) | — | — | 0 | .3282 |
| 7-2 | polyvinylpyrrolidone | 45,000 | 0.75 | .3241 |
| 7-3 | polyvinylpyrrolidone | 900,000 | 0.75 | .3118 |
| 7-4 | polyvinylpyrrolidone | 1,200,000 | 0.75 | .3195 |
| 7-5 | polyethylene oxide | 400,000 | 0.75 | .3407 |
| 7-6 | polyacrylamide | >100,000 | 0.75 | .3223 |
| 7-7 | poly(acrylic acid) | 450,000 | 0.75 | .2304 |

The polyvinylpyrrolidone and polyethylene oxide and polyacrylamide nonionic polymers were relatively ineffective at reducing particle sizes in comparison to the ionic polymer poly(acrylic acid).

Example 8

Dispersions were made using the same oil phase as described in Example 1. Two types of photographic gelatin with different inherent viscosities were used. Gelatin I is the same conventional photographic lime processed gelatin used in examples 1–7. Gelatin II is a lower viscosity lime processed gelatin obtained in an earlier extraction in the gel manufacturing process than Gelatin I (see, e.g., "Theory of the Photographic Process", Fourth Edition, Chapter 2, Ed. T. H. James, Macmillan Publishing Co., 1977). The gelatins are characterized by their molecular weight distributions which were measured by Size Exclusion Chromatography, using a TSK G4000 SW column made by Tosohaas. The weight fraction of molecules having a molecular weight greater than 150,000 for Gelatin I is 0.4196 while that for Gelatin II is 0.3237.

The dispersions were made under similar conditions as described in Example 1 using Compound I, which is a product made by National Starch Chemical Co. under the name TL-70 and has a designated molecular weight of 55,000, as the polyelectrolyte.

| Dispersion # | gel type | gel level % | aq. visc. | q | polymer level % | particle size μm | disp. visc @ 37.5 $s^{-1}$ |
|---|---|---|---|---|---|---|---|
| 8-1 (check) | Gelatin I | 8 | 55 | 1.54 | 0 | .2493 | 111 |
| 8-2 | Gelatin I | 4 | 11.5 | 7.4 | 0.75 | .2524 | 177 |
| 8-3 | Gelatin II | 4 | 9.33 | 9.1 | 0.75 | .2524 | 115 |

It is seen that by using a combination of polymeric dispersing aid and low viscosity gelatin, one is able to obtain small particle size dispersions at half the level of gelatin and with the same dispersion viscosity.

Example 9

Dispersions were made using the same oil phase as described in Example 1. The gelatins used in these experiments was regular lime processed photographic gel and an Acid Processed Ossein (APO) gel, which has a significantly lower molecular weight than the regular lime processed gel. The dispersions were made under similar conditions as described in Example 1 using Compound I, which is a product made by National Starch Chemical Company under the name TL-70 and has a designated molecular weight of 55,000, as the polyelectrolyte. The value of q for the 4% APO gel dispersions was 32.7.

| Dispersion # | gel % | gel type | % of pol. | particle size μm | viscosity cp |
|---|---|---|---|---|---|
| 9-1 | 8 | regular | 0 | .2493 | 111 |
| 9-2 | 4 | regular | 0.75 | .2524 | 177 |
| 9-3 | 8 | APO | 0 | .3181 | 18.7 |
| 9-4 | 4 | APO | 0 | .3713 | 4.5 |
| 9-5 | 4 | APO | .25 | .3431 | 8.15 |
| 9-6 | 4 | APO | .5 | .3245 | 14.5 |
| 9-7 | 4 | APO | .75 | .295 | 20.4 |
| 9-8 | 4 | APO | 1 | .2915 | 21.5 |

The ionic polymer helps in reducing the particle size even when APO gelatin is used. Thus APO gel, which is less expensive than regular photographic gel, can be used as a substitute and the increase in particle size that is obtained by the substitution can be partially offset by adding the polyelectrolyte. Additional benefits of using the combination of APO gel and polyelectrolyte is the low dispersion viscosity.

The invention has been described in detail with particular reference to preferred embodiments thereof, but it is to be understood that variations and modifications can be effected within the spirit and scope of the invention.

What is claimed is:

1. A process for making a direct dispersion of a photographically useful material comprising: subjecting a mixture of an aqueous gelatin solution, a liquid organic phase comprising a photographically useful material, and an ionic polymer to conditions of high shear or turbulence to form a fine dispersion of the organic phase having an average particle size of less than 0.5 micron dispersed in the aqueous solution; wherein the ratio of the organic phase viscosity to the aqueous gelatin solution viscosity in the absence of the ionic polymer, measured at the temperature of the dispersion forming step, is greater than a value of 2.0, and the ionic polymer is a water soluble or dispersible substantially non-surface active polyelectrolyte which has a molecular weight of at least 10,000 selected from:

i) synthetic polymers derived from at least 5 mole % of monomers which contain —$OSO_3M$, —$SO_3M$, —COOM, or —$OPO(OM)_2$ substituent groups where M represents a hydrogen atom or a cationic counterion, and ii) polysaccharide materials bearing at least one suDstituent group as described in i) per saccharide unit.

2. The process of claim 1 where the ionic polymer has a molecular weight between 10,000 and 1,000,000.

3. The process of claim 1 where the ionic polymer has a molecular weight between 20,000 and 800,000.

4. The process of claim 1 where the ionic polymer comprises at least 20 mole % of ionic monomer units.

5. The process of claim 1 where an anionic or nonionic surfactant is present in the aqueous solution.

6. The process of claim 5 where the surfactant is anionic and has a —$OS_3M$ group where M is as defined in claim 1.

7. The process of claim 1 where the weight fraction of the component of gelatin in the aqueous solution having a molecular weight of greater than 150,000 is less than 0.35.

8. The process of claim 7 where the molecular weight of the ionic polymer is less than 500,000.

9. The process of claim 1, wherein the ionic polymer is added at a level up to 50% by weight of the amount of the gelatin in the aqueous solution.

10. The process of claim 1, wherein the ionic polymer is added at a level of from 1 to 40% by weight of the amount of the gelatin in the aqueous solution.

11. The process of claim 1, wherein the ionic polymer is added at a level of from 1 to 25% by weight of the amount of the gelatin in the aqueous solution.

12. The process of claim 1, wherein the mixture of an aqueous gelatin solution, an organic phase comprising a photographically useful material, and an ionic polymer is formed by first forming a coarse dispersion of the organic phase in the aqueous solution and subsequently adding the ionic polymer to the coarse dispersion.

13. The process of claim 1, wherein the ionic polymer is a synthetic polymer derived from at least 5 mole % of monomers which contain —$OSO_3M$, —$SO_3M$, —COOM, or —$OPO(OM)_2$ substituent groups.

14. The process of claim 1, wherein the ionic polymer is a polysaccharide material bearing at least one —$OSO_3M$, —$SO_3M$, —COOM, or —$OPO(OM)_2$ substituent group per saccharide unit.

15. The process of claim 14, wherein the polysaccharide material comprises at least two —$OSO_3M$, —$SO_3M$, —COOM, or —$OPO(OM)_2$ substituent groups per saccharide unit.

16. The process of claim 1 in which essentially no volatile or water-miscible organic solvent is present in the organic phase.

* * * * *